US005900826A

United States Patent [19]

Farber

[11] Patent Number: 5,900,826

[45] Date of Patent: May 4, 1999

[54] REMOTE CONTROLLED PORTABLE TRAFFIC SIGNALS

[76] Inventor: Gary J. Farber, P.O. Box 2004, Tunkhannock, Pa. 18657-0904

[21] Appl. No.: 08/757,343

[22] Filed: Nov. 27, 1996

[51] Int. Cl.[6] ..... G08G 1/095

[52] U.S. Cl. ..... 340/908; 340/908.1; 340/917; 340/539; 116/63 P

[58] Field of Search ..... 340/908, 908.1, 340/539, 917, 928; 116/63 P; 40/606, 607, 612, 544

[56] References Cited

U.S. PATENT DOCUMENTS

| | | | |
|---|---|---|---|
| 2,401,940 | 6/1946 | Lange | 177/337 |
| 2,829,362 | 4/1958 | Terrill | 340/22 |
| 2,941,185 | 6/1960 | Mullikin | 340/41 |
| 3,046,521 | 7/1962 | Cantwell et al. | 340/41 |
| 3,729,706 | 4/1973 | Hein | 340/908 |
| 3,867,718 | 2/1975 | Moe | 340/31 |
| 4,032,883 | 6/1977 | Gibson | 340/41 |
| 5,437,318 | 8/1995 | Martel | 340/928 |

*Primary Examiner*—Jeffrey A. Hofsass
*Assistant Examiner*—Julie Lieu
*Attorney, Agent, or Firm*—Joseph W. Molasky & Associates

[57] ABSTRACT

A portable traffic control comprising two display units, each responsive to a transmitter's radio signals, each display unit comprising a "stop" and a "go" lamp, the light from all lamps viewable by a person positioned between the display units. The system is optionally equipped with an audio warning means for detecting vehicles that ignore a display unit stop light, the display units each preferably employing a simplified circuit with a servo motor mechanism.

8 Claims, 4 Drawing Sheets

REMOTE CONTROLLED PORTABLE TRAFFIC SIGNALS

FIELD OF THE INVENTION

This invention relates to a portable traffic control system which is operated by radio transmitter means.

BACKGROUND OF THE INVENTION

Portable traffic control systems particularly suited to controlling traffic in work areas have been disclosed (e.g., Moe, U.S. Pat. No. 3,867,718; Terrill, U.S. Pat. No. 2,829,362). Normally, the systems are used on roads that have two traffic lanes, each for traffic in a different direction. When repair work is being performed on one lane of the road, however, the traffic in both directions must use the other lane. The control systems employ traffic lights at each end of the traffic lane, alternately presenting a go signal first to traffic from one direction and then to traffic from the other direction. The signals are not only viewable by oncoming traffic but also by an operator standing between the display units.

It would be desirable, however, to have improved traffic control systems, for example, one having a warning device that is activated by the vehicle of a driver who ignores or does not notice a stop light. It would also be desirable to have a system that uses simplified control circuits with fewer moving parts so as to minimize repair costs for the circuits. Furthermore, it would be preferable that neither red nor green lights on the back side of a display unit be used to convey information to a person behind that display unit about the status of the traffic lights on its front side, since such lights might prove confusing to drivers who are supposed to respond to the front traffic lights on the other display unit.

BRIEF SUMMARY OF THE INVENTION

It is an object of the invention to provide a traffic control system that comprises an audio warning device that is activated by the vehicle of a driver who ignores or does not notice a stop light.

It is a further object of the invention to provide a portable traffic control system that employs two display units whose go lights and stop lights are viewable not only by oncoming traffic but also by a person standing between the display units.

It is a further object of the invention to provide a portable traffic control systems that uses a minimum of moving parts.

It is a further object of the invention to provide a traffic control system that does not use a red light or a green light to transmit information to an operator between the display units.

The invention can be most generally summarized as a system that comprises the following:

a transmitting means that independently transmits a signal at a first radio frequency and a signal with a second radio frequency, a first display unit and a second display unit, each for positioning at one of the two ends of a traffic lane, the first display unit responsive to a signal with the first radio frequency, the second display unit responsive to a signal with the second radio frequency, wherein each display unit comprises a traffic side with a go-traffic lens and a stop-traffic lens, a monitor side with a go-monitor lens and a stop-monitor lens, a go lamp positioned to radiate light through the go-traffic lens and go-monitor lens, a stop lamp positioned to radiate light through the stop-traffic lens and the stop-monitor lens, an antenna for receiving a radio signal from the transmitter, a switching means connected to said antenna such that said switching means turns the go lamp on and the stop lamp off when the antenna receives a radio signal.

In a particularly preferred embodiment, each display unit comprises a photoelectric cell capable of emitting and receiving a beam of light, a warning means that emits a sound or light if the beam of light is emitted but not received by the photoelectric cell, said traffic control system further comprising a first reflector unit and a second reflector unit, each of said reflector units comprising a reflecting means for reflecting a beam of light from the emitter to the receiver.

In a second preferred embodiment, the go-monitor lens and the stop-monitor lens of each display unit transmit light of a color (preferably amber) not transmitted by either a go-traffic lens or a stop-traffic lens.

In a third preferred embodiment, the switching means in each display unit comprises a servo motor that in response to an electrical signal from the antenna moves a lever from a first position to a second position, the position of said lever controlling whether the electric current flows to the go-traffic lamp or to the stop-traffic lamp, said switching means electrically connected to said antenna.

The system can be constructed to include any single preferred embodiment, any two of them simultaneously, or all three of them simultaneously. Any embodiment can be constructed in tandem so as to create a tandem portable control system for use at the intersection of two traffic lanes, each from a different road; preferably using a single transmitting means.

DETAILED DESCRIPTION OF THE EXAMPLES

FIGS. 1–6 exemplify the invention.

Figure 1:
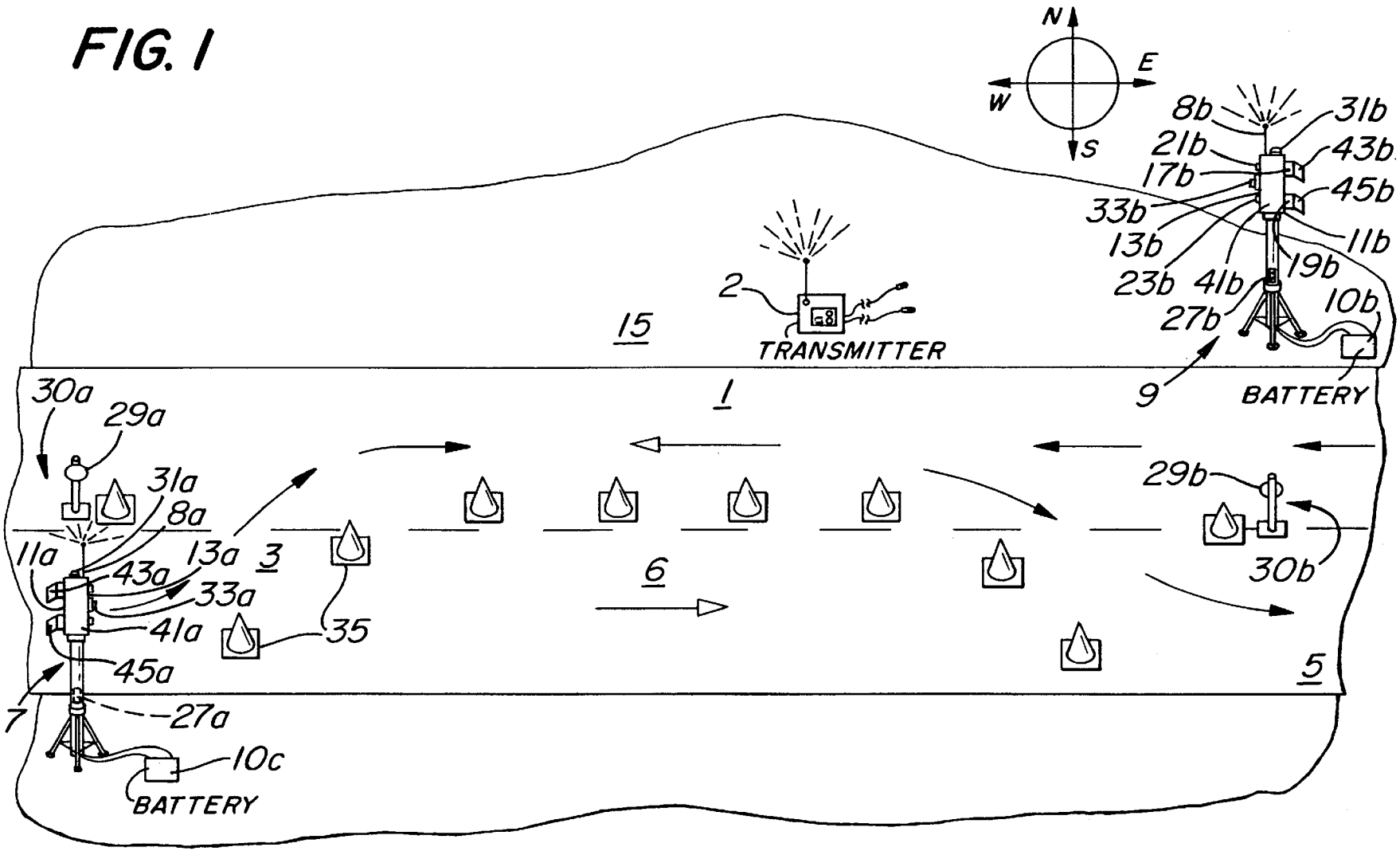
FIG. 1 is a schematic drawing of a perspective view of an example of the traffic control system.

FIG. 1 shows transmitter 2 located at position 15 at the side of traffic lane 1, a lane that starts at its first end 3 and ends at its second end 5. The transmitter sends radio signals at a first radio frequency to the first display unit 7, which is located at first end 3 of traffic lane 1 and at a second radio frequency to the second display unit 9, which is located at second end 5 of that traffic lane. The first display unit 7 comprises an enclosure box 41*a*, which as subsequently described, is adapted to enclose most of the display unit's functioning parts. The second display unit 9 similarly comprises an enclosure box 41*b*.

Figures 2, 6:
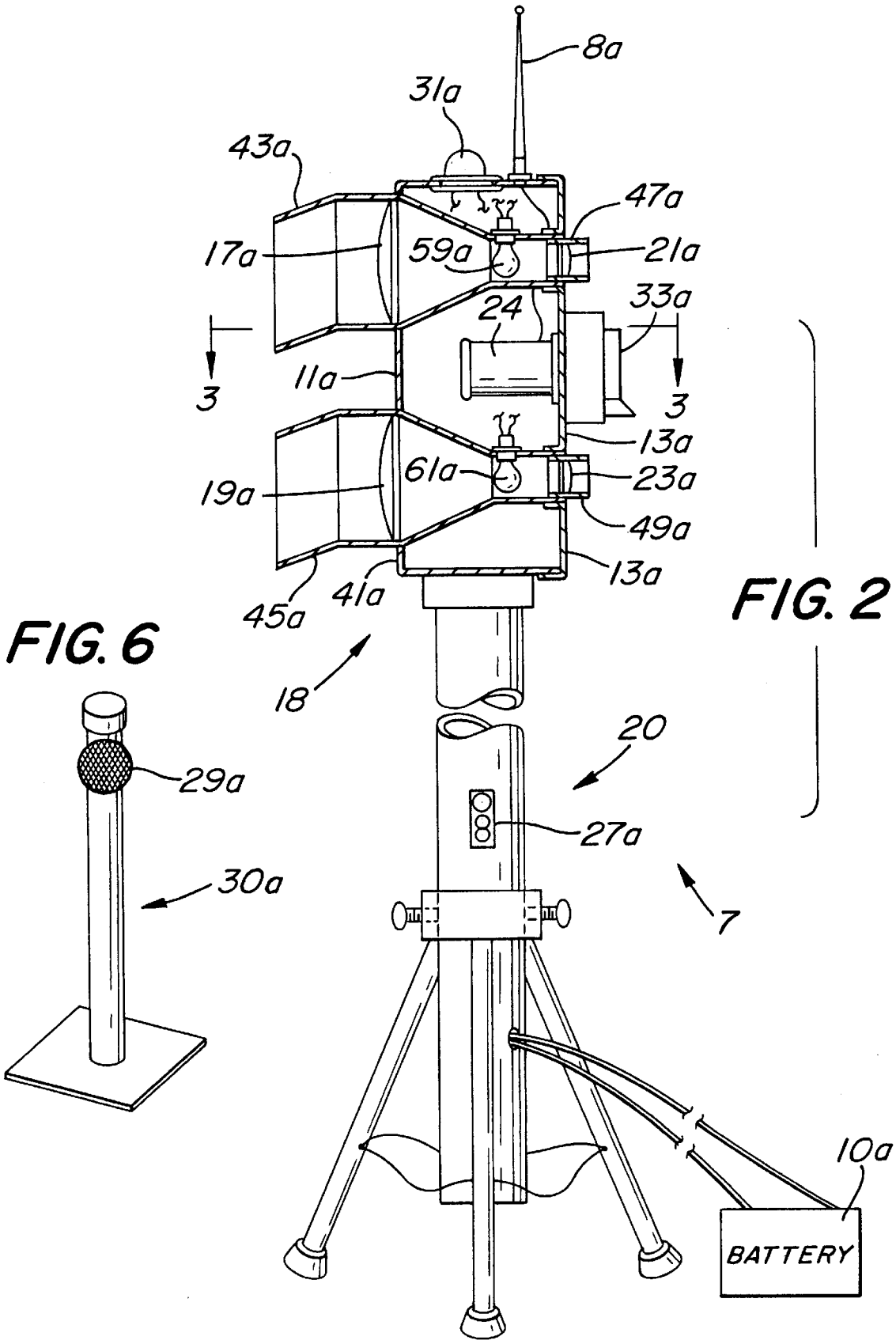
FIG. 2 is a side elevational view of a display unit and a warning system reflector unit, both also shown in FIG. 1; the enclosure box is shown in cross section.
FIG. 6 is an enlarged perspective view of a reflector unit shown in FIG. 1.

The traffic side 11*a* of enclosure box 41*a* is oriented to face traffic coming from the west whereas the traffic side 11*b* of enclosure box 41*b* faces traffic coming from the east. As seen in FIG. 2, a go-traffic lens 19*a* (green) and a stop-traffic lens 17*a* (red) in the traffic side 11*a* of enclosure box 41*a* are visible to traffic coming from the west. Light transmitted through lenses 17*a* or 19*a* can be seen by a person in a vehicle approaching the enclosure box from its traffic side. FIG. 1 also shows the go-traffic lens 19*b* and the stop-traffic lens 17*b* on the traffic side 11*b* of enclosure box 41*b* of the second display unit 9, which lenses transmit light visible to a person in a vehicle approaching from the east.

Which of the four lenses, 17*a*, 17*b*, 19*a*, and 19*b*, transmit light is determined by radio signals from the transmitter 2. Radio signals of the first frequency are received by an antenna 8*a* of the first display unit 7, whereas radio signals of the second frequency are received by an antenna 8*b* of the second display unit 9. Monitor lenses 21*a*, 21*b*, 23*a* and 23*b*, correspond to traffic lenses, 17*a*, 17*b*, 19*a*, and 19*b*, respectively. A monitor lens will transmit light if and only if its corresponding traffic lens is transmitting light. Therefore, because they are on the monitor sides 13*a* and 13*b* of the display units, and are therefore visible to a person operating the transmitter at position 15, the monitor lights allow such a person to know which of the four traffic lenses are transmitting light. Monitor lights preferably transmit light of a color not transmitted by either the go-traffic light or the stop-traffic light.

The traffic lenses 17*a*, 17*b*, 19*a*, and 19*b*, of display units 7 and 9 are at the ends of viewing channels 43*a*, 43*b*, 45*a*, and 45*b*. That is shown more clearly in FIG. 2. FIG. 2 also shows that the monitor lenses 21*a* and 23*a* are also each at the ends of viewing channels 47*a* and 49*a*, respectively. The monitor lenses 21*b* and 23*b* of display unit 9 are similarly at the end of viewing channels.

Elements of an optional warning system are also shown in FIG. 1. The purpose of the warning system is to warn a person in the vicinity of the traffic control system that a vehicle has ignored a stop-traffic light from a display unit and is in the process of passing that display unit. The display units 7 and 9 are part of the warning system. Unit 7 comprises a photoelectric cell 27*a* that emits and receives a surveillance light beam. A surveillance light beam emitted by cell 27*a* is reflected by reflector means 29*a* of reflector unit 30*a*. The surveillance light beam is emitted only while the stop-traffic lens 17*a* of display unit 7 is transmitting light, such as red light. Furthermore, there is normally a short delay (e.g., 3 seconds), or grace period, between the time a red light is transmitted by a stop-traffic lens and the time that the surveillance light beam is activated. The display unit 7 has an amber warning light 31*a* and a warning horn 33*a*. Should a vehicle ignore the red stop signal emitted by stop traffic lens 17*a* and drive through the surveillance light beam, then the resulting failure of the photoelectric cell 27*a* to detect the surveillance beam will result in the amber warning light 31*a* flashing and the warning horn 33*a* sounding. Display unit 9 is similarly equipped with an amber warning light 31*b*, a warning horn 33*b*, and a photoelectric cell 27*b* that is used in conjunction with reflector unit 30*b* and that unit's reflector means 29*b*.

The first and second display units are powered by 12-volt batteries 10*a* and 10*b*, respectively.

In order to optimally implement the traffic control system, including the warning system, the traffic is routed by traffic cones 35 (only 2 of the 11 cones in the Figure are denoted with a 35). In FIG. 1, the west-to-east lane 6 is the lane undergoing repair in the work zone 4 and therefore west-to-east traffic is routed away from that lane until it passes the work zone. As a result, a vehicle coming from the west towards the traffic side 11*a* of enclosure box 41*a* of the first display unit 7 will still be in its normal lane while it passes between the display unit and the reflector unit 30*a*. Before it has a chance to pass between the second display unit 9 and the reflector 30*b*, however, it is routed back by the traffic cones to its normal west-to-east lane.

The transmitter 2 can be a conventional transmitting means of a type that can transmit a radio signal at either a first radio frequency (to be received by display unit 7) or a second radio frequency (to be received by display unit 9). For example, this can be accomplished by using two conventional radio frequencies transmitters, each fitted with a lever that has both an on position and an off position, so that the transmitter will transmit a radio signal only if the lever is in the on position. The transmitter need not be a manually operated one but rather can be an automatic transmitting means, that will transmit the radio signals of the first and second frequencies on an alternating basis: such as the first signal for 30 seconds, a dual off mode (stop traffic lights of both display units are red) for 30 seconds, the second signal for 30 seconds, then the first signal for 30 seconds, and so on. Automation can be achieved by rigidly positioning the two transmitters in a holder box equipped to alternately turn the transmitters levers to the on and off positions. The holder box, in such a case, would contain a rotating bendable spring rod that rotates by virtue of the fact that it is fixed to a rotating gear continually rotated by a worm gear linked to a motor, such as a 12 volt motor. The rotating spring rod strikes a lever to switch that lever from its off position to its on position, and maintains the lever in its on position as long as it is in contact with the lever. When the rod is dragged by the rotating gear far enough so that the rod's contact with the lever is broken, the lever springs back to a default off position.

FIG. 2 is an enlarged view of a display unit 7. In the figure, the bottom portion 20 of the display unit is drawn showing it rotated 180 degrees from its actual position with respect to the top portion 18 of the display unit. In addition to showing features identified in FIG. 1, FIG. 2 shows go-traffic lamp 61*a*, which radiates light that passes through go-traffic lens 19*a* and go-monitor lens 23*a*. Stop-traffic lamp 59*a* radiates light that passes through stop-traffic lens 17*a* and stop-monitor lens 21*a*. FIG. 2 also shows a timer unit 24 discussed more fully below.

Figure 3:
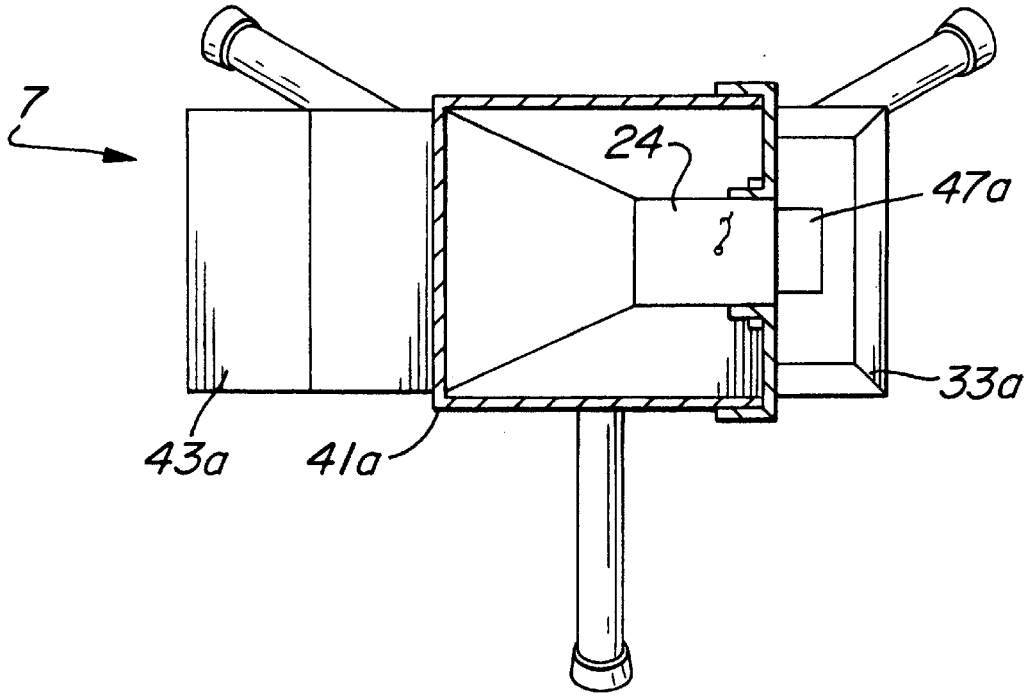
FIG. 3 is a cross-sectional view taken in the direction of arrows 3—3 of FIG. 2.

FIG. 3 is a cross-sectional view of display unit 7. Visible are the light channels 43*a* and 47*a*, and the warning horn 33.

Figure 5:
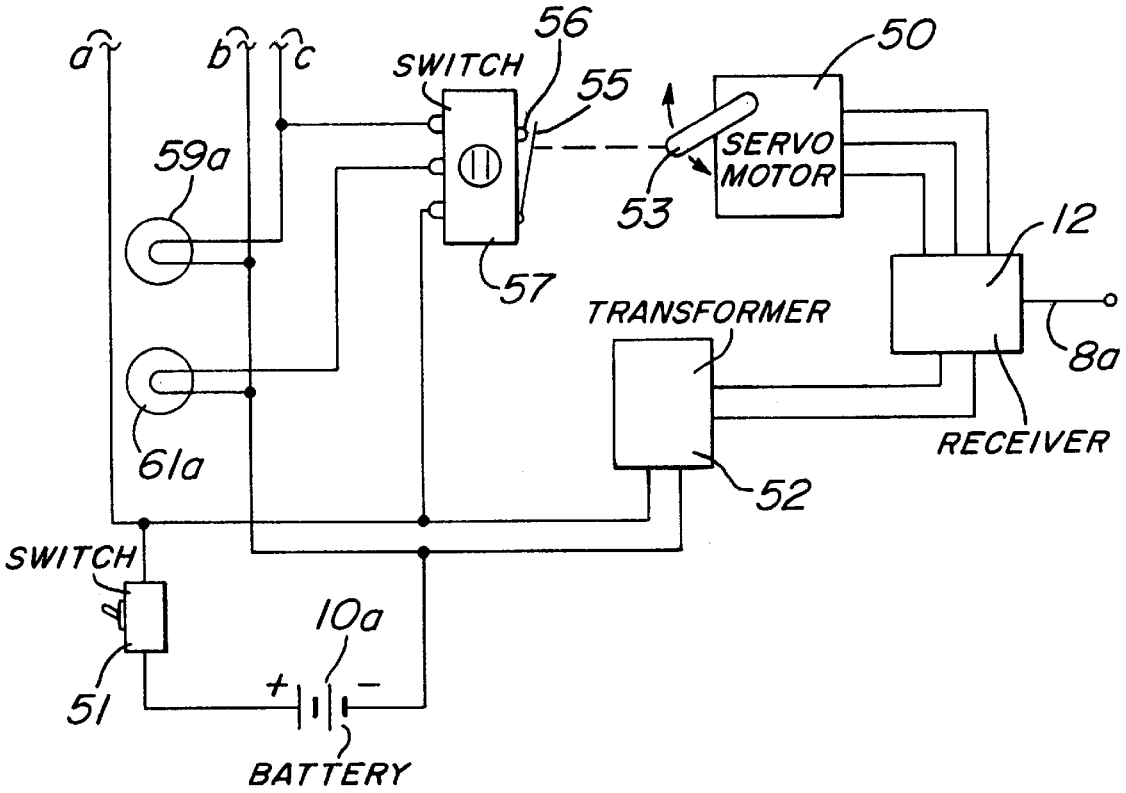
FIG. 5 is a schematic view of a circuit used in the display unit in FIG. 1.

FIG. 5 is a diagram illustrating a circuit in enclosure box 41*a* of first display unit 7. The antenna 8*a* is connected by a receiver 12 to a servo motor 50 (e.g., a 4.8 volt servo motor). Activation of the servo motor 50 is controlled by a two-position switch 51 that controls current flow to the servo motor from a step-down transformer 52(e.g., a 4.8 volt transformer) connected to a battery 10*a* (e.g., a 12-volt battery). When switch 51 is in its on position so as to permit such current flow, the receiver 12 is responsive to a radio signal of the first radio frequency received by antenna 8*a*, and the receiver sends an electrical signal to the servo motor 50 causing a non-conductive arm 53 of the servo motor to press against lever 55 of a lever switch 57 so that the lever switch makes contact with contact point 56, contact that allows current flow to go-traffic lamp 61*a* but not to stop-traffic lamp 59*a*. If the arm 53 is not pressed against lever 55 then lever switch 57 allows current flow to stop-traffic lamp 59*a* but not go-traffic lamp 61*a*. Both the go-traffic lamp and the stop-traffic lamp are powered by battery 10*a*.

Figure 4:
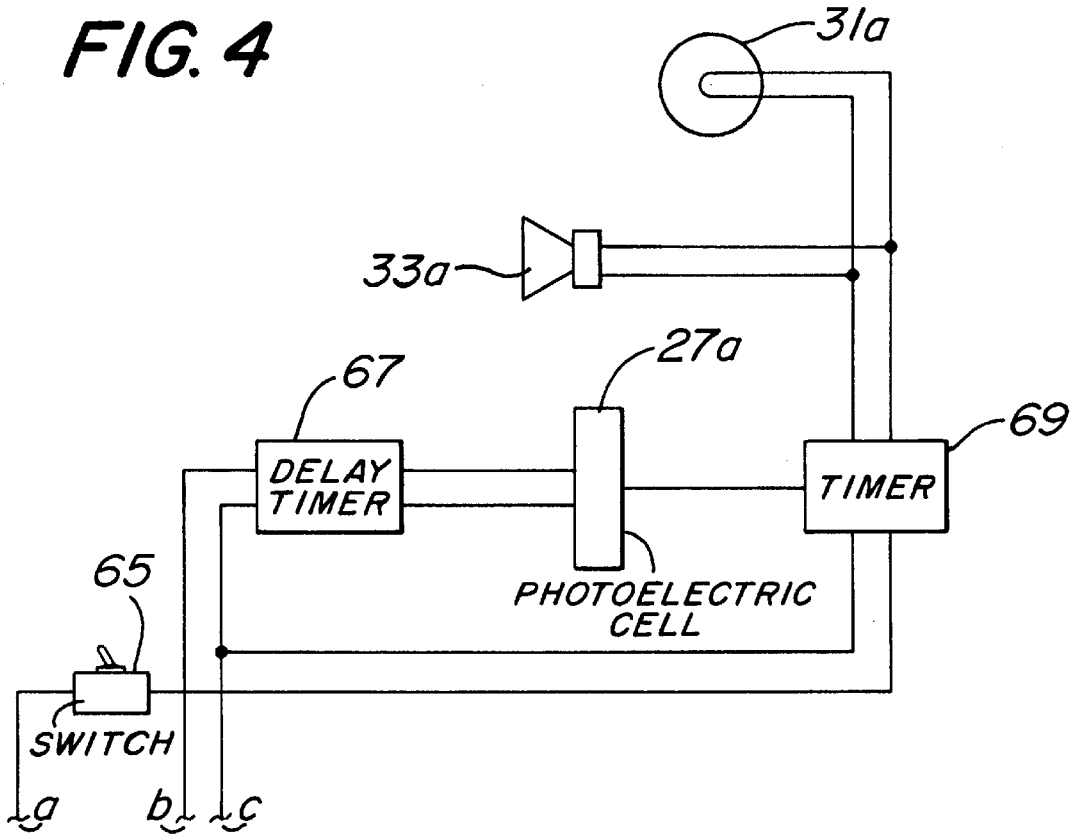
FIG. 4 is a schematic view of a circuit used in the display unit in FIG. 1 as part of the warning system.

FIG. 4 shows a warning system circuit that can be connected to the circuit in FIG. 5 by leads a, b, and c. The warning system is activated if two-position switch 65 is in its "on" position. When the warning system is activated, the photoelectric cell 27*a* will be on or off depending on whether delay timer 67 sends it an electrical signal turning it on or an electrical signal turning it off. Delay timer 67 turns the photoelectric cell on a preset time interval (preferably 3 seconds) after the time that the red light goes on. If the photoelectric cell is on but is not receiving a surveillance light beam, it sends an electrical signal causing warning light 31*a* to be lit and warning horn 33*a* to sound an alarm. However, timer 69 can be preset to control the length of time (preferably 20 seconds) that the warning system is on and to then reset itself for a subsequent signal, if any, from photoelectric cell 27*a*. Both timer 67 and timer 69 are part of timer unit 24 shown in FIG. 2.

Enclosure box 41*b* is constructed in the same manner as enclosure box 41*a* except that its servo motor is adapted to respond to the second radio frequency.

The display units can be further equipped with an amber traffic lamp, amber-traffic lens on the traffic side of the enclosure box, and amber-monitor lens on the monitor side of the enclosure box. The amber traffic lamp is connected to the warning circuit shown in FIG. 4 such that it will be on and radiating light during the delay period, controlled by timer 67, that follows the activation of the stop traffic lamp.

While the preferred embodiments have been fully described and depicted for the purposes of explaining the principles of the present invention, it will be appreciated by those skilled in the art that modification and changes may be made thereto without departing from the scope of the invention set forth in the appended claims.

What is claimed is:

1. A portable traffic control system comprising an automatic transmitting means that independently transmits a first signal at a first radio frequency and a second signal at a second radio frequency;

a first display unit and a second display unit, each for positioning at one of the two ends of a traffic lane, the first display unit being responsive to the first signal, the second display unit being responsive to the second signal, wherein each display unit comprises a traffic side with a go-traffic lens and a stop-traffic lens, a monitor side with a go-monitor lens and a stop-monitor lens, wherein the go-monitor lens and the stop-monitor lens of each display unit transmit light of a color not transmitted by either a go-traffic lens or a stop-traffic lens, a go lamp positioned to radiate light through the go-traffic lens and go-monitor lens, a stop lamp positioned to radiate light through the stop-traffic lens and the stop-monitor lens, an antenna for receiving a radio signal from the transmitting means, and a switching means connected to said antenna such that said switching means turns the go lamp on and the stop lamp off when the antenna receives a radio signal wherein each display unit further comprises a photoelectric cell capable of emitting and receiving a beam of light, a warning means that emits a sound or light if the beam of light is emitted but not received by the photoelectric cell, said traffic control system further comprising a first reflector unit and a second reflector unit, each of said reflector units comprising a reflecting means for reflecting a beam of light from the emitter to the receiver.

2. A traffic control system of claim 1 wherein the warning means emits a sound.

3. A traffic control system of claim 1 wherein the warning means emits a light.

4. A traffic control system of claim 1 wherein the switching means in each display unit comprises a servo motor that in response to an electrical signal from the antenna moves a lever from a first position to a second position, the position of said lever controlling whether the electric current flows to the go-traffic lamp or to the stop-traffic lamp, said switching means electrically connected to said antenna.

5. A tandem portable control system comprising a first portable traffic system of claim 1 in combination with a second portable traffic system of claim 1 at the intersection of two traffic lanes.

6. A tandem portable control system of claim 5 wherein the same transmitting means is used for the first portable traffic system and the second portable traffic system.

7. A traffic control system of claim 1 wherein the automatic transmitting means is configured to have an alternating transmitting pattern of: transmitting the first signal, transmitting no signal, transmitting the second signal, transmitting no signal, transmitting the first signal, and so on.

8. A traffic control system of claim 7 wherein the automatic transmitting means transmits each signal for a similar duration.

* * * * *